United States Patent [19]

Kenner

[11] Patent Number: 4,696,068

[45] Date of Patent: Sep. 29, 1987

[54] SHOWER WALL AND BATHTUB MOUNTED BACK WASHER

[76] Inventor: Mary B. Kenner, 1 Mile Course, Kings Mill, Williamsburg, Va. 23185

[21] Appl. No.: 886,334

[22] Filed: Jul. 17, 1986

[51] Int. Cl.[4] ..... A47K 7/02

[52] U.S. Cl. ..... 4/606

[58] Field of Search ..... 4/606, 581-583, 4/605, 661; 15/104.92; 206/235, 823

[56] References Cited

U.S. PATENT DOCUMENTS

| | | | |
|---|---|---|---|
| 3,289,215 | 12/1966 | Kennedy | 4/606 |
| 3,750,226 | 8/1973 | Morgan | 4/606 |
| 4,020,519 | 5/1977 | Robison | 4/606 |
| 4,047,259 | 9/1977 | Lotis | 4/583 |
| 4,417,362 | 11/1983 | Walker | 4/606 |

FOREIGN PATENT DOCUMENTS

| | | | |
|---|---|---|---|
| 2426432 | 12/1975 | Fed. Rep. of Germany | 4/606 |

*Primary Examiner*—Stephen Marcus
*Assistant Examiner*—L. J. Peters
*Attorney, Agent, or Firm*—Harvey B. Jacobson

[57] ABSTRACT

A back washer and massager supported on a shower wall or bathtub and includes a pad of foam plastic with a waterproof cover and a rigid backing plate supported by a plurality of suction cups with a terry cloth or similar fabric cover mounted on the pad to enable easy removal for laundering and the like with the cover for the pad including a pocket on the interior surface thereof to receive soap positioned in a net bag so that a person taking a shower or bath can position their back or any other inaccessible area of their body against the surface of the terry cloth or other fabric cover and by moving the body area engaged with the cover provide a washing or massaging function on the surface area of the body.

4 Claims, 3 Drawing Figures

SHOWER WALL AND BATHTUB MOUNTED BACK WASHER

BACKGROUND OF THE INVENTION

1. Field of the Invention

The present invention generally relates to a back washer and massager supported on a shower wall or bathtub and includes a pad of foam plastic with a waterproof cover and a rigid backing plate supported by a plurality of suction cups with a terry cloth or similar fabric cover mounted on the pad to enable easy removal for laundering and the like with the cover for the pad including a pocket on the interior surface thereof to receive soap positioned in a net bag so that a person taking a shower or bath can position their back or any other inaccessible area of their body against the surface of the terry cloth or other fabric cover and by moving the body area engaged with the cover provide a washing or massaging function on the surface area of the body.

2. Information Disclosure Statement

Various devices and efforts have been made to enable persons to more efficiently wash and massage their back or other inaccessible surface areas. However, presently known devices do not incorporate the structural features and functional capabilities of the present invention.

SUMMARY OF THE INVENTION

An object of the invention is to provide a back washer for mounting on a shower wall, bathtub or similar area by which a person may wash, scrub and massage hard to reach and generally inaccessible surface areas of their body.

Another object of the invention is to provide a back washer in accordance with the preceding object which includes a foam plastic pad provided with a waterproof enclosure and a removable cover of fabric material and a suction cup mounting assembly for securing the device on a wall surface so that the cover may be wetted and provided with soap or other material so that the person using the device can place an inaccessible surface area of their body against the back washer and by moving their body surface an effective washing, scrubbing and massaging of the surface area of the body may be effectively accomplished.

A further object of the invention is to provide a back washer in accordance with the preceding objects in which the mounting assembly includes a generally rigid backing plate for the pad having a plurality of suction cups mounted thereon with the interior of the cover including a pocket for receiving a net-type container for soap scraps and the like to enable effective use of normally discarded soap scraps for effectively washing the back or any other inaccessible surface area of a person's body.

Still another object of the invention is to provide a back washer in accordance with the preceding objects in which the removable cover is secured to the pad and backing plate by a drawstring incorporated into a peripheral hem with the cover being terry cloth or similar fabric material which can be easily laundered with the absorbency of the fabric cover enabling various other liquids or ointments to be absorbed therein for ma purposes and the like with the device being capable of use in bed when a limited quantity of material is placed on the absorbent fabric cover with the structure also being capable of receiving a hot water bottle in the pocket on the interior of the cover or between the cover and the outer surface of the pad so that the hot water bottle may be more effectively retained against the surface area of the body.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 2:
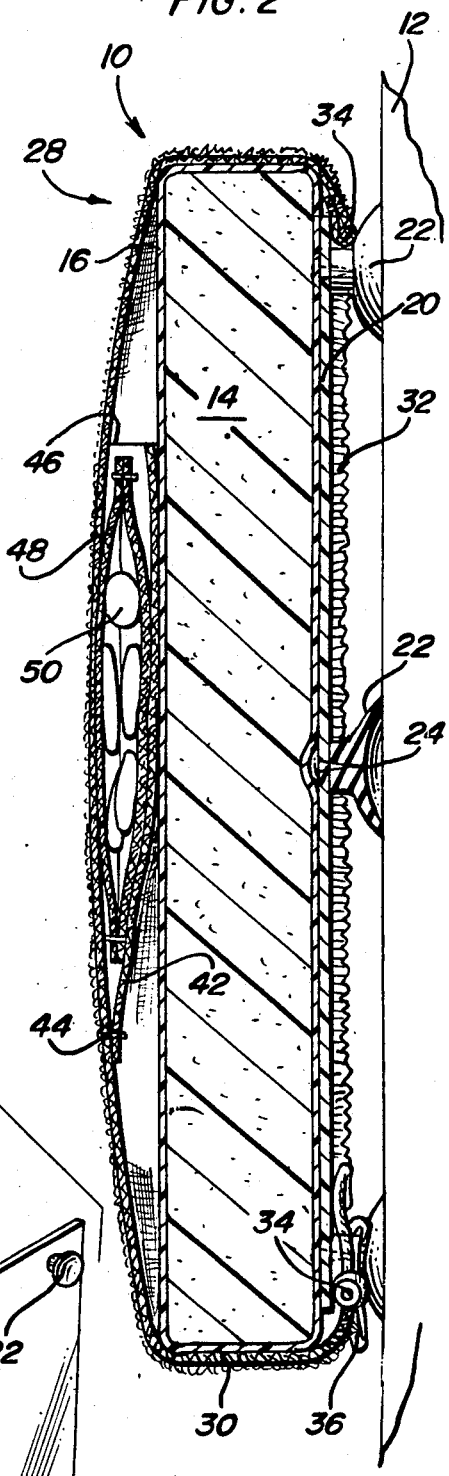
FIG. 2 is a vertical sectional view, on an enlarged scale, taken substantially upon a plane passing along section line 2--2 on FIG. 1 illustrating the device mounted on a vertical wall and the specific structural details thereof.
Figure 3:
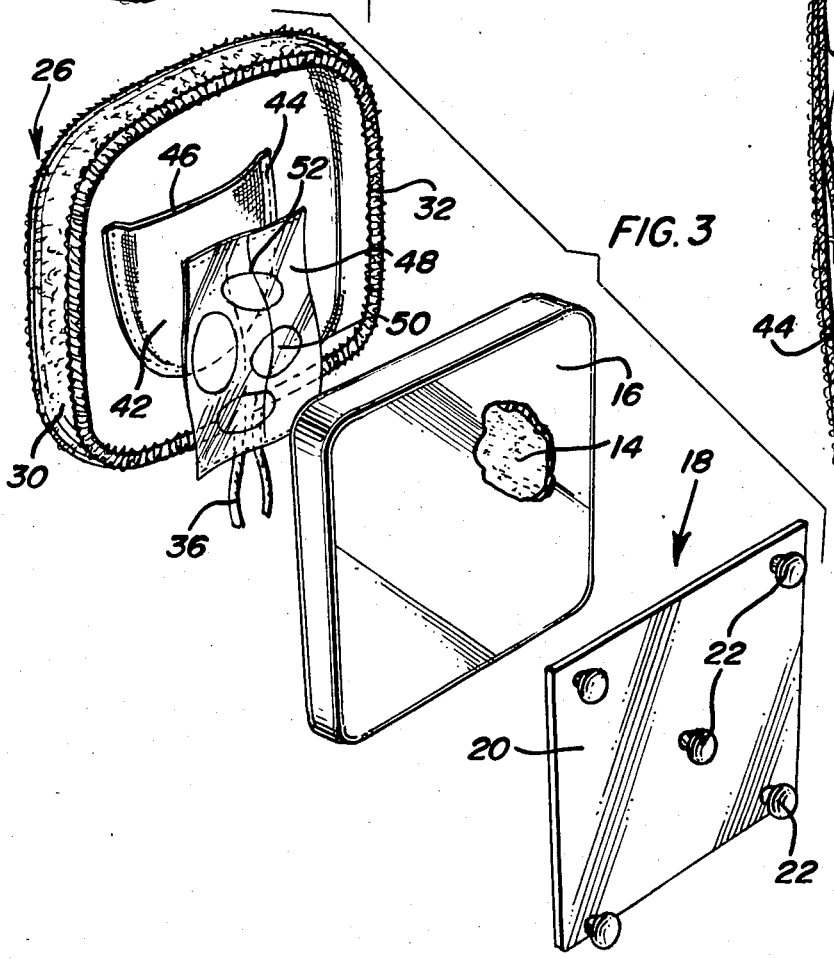
FIG. 3 is an exploded group perspective view of the back washer of the present invention.

Referring now specifically to the drawings, the back washer of the present invention is designated by reference numeral 10 and, in FIG. 2, is illustrated in use on a vertical wall 12 which may be the wall of a shower. The device may be also used on the wall surface of a bathtub including the inclined end wall or in any other location where the structure can be effectively used.

The back washer 10 includes a pad 14 which may be square or of any desired shape or size and constructed of foam plastic material such as polyurethane having substantial thickness. The pad 14 is provided with a waterproof cover 16 of flexible plastic material which may be transparent in order to prevent contact of water with the foam pad 14.

A mounting assembly generally designated by the numeral 18 supports the back washer on the wall 12 with the mounting assembly including a substantially rigid panel 20 of generally the same size and shape as the pad 14 with the panel 20 being constructed of transparent plastic material having substantial rigidity but also having a degree of flexibility with a relatively thin panel of "Plexiglas" being satisfactory for this purpose. The panel 20 is supported by five suction cups 22 located respectively at the corners of the panel 20 and at the center thereof with each of the suction cups being secured to the panel by a fastener such as a screw threaded fastener 24 extending through the panel 20 and into the neck or body of the suction cup 22. The panel 20 will be supported at the four corners thereof and at the center thereof to generally maintain its rigidity but still enable some degree of flexibility due to the flexibility of the suction cups and the flexibility of the panel 20 with the suction cups being constructed of resilient plastic or rubber material as is conventional with the suction cups effectively but detachably supporting the back washer on a wall surface 12.

Figure 1:
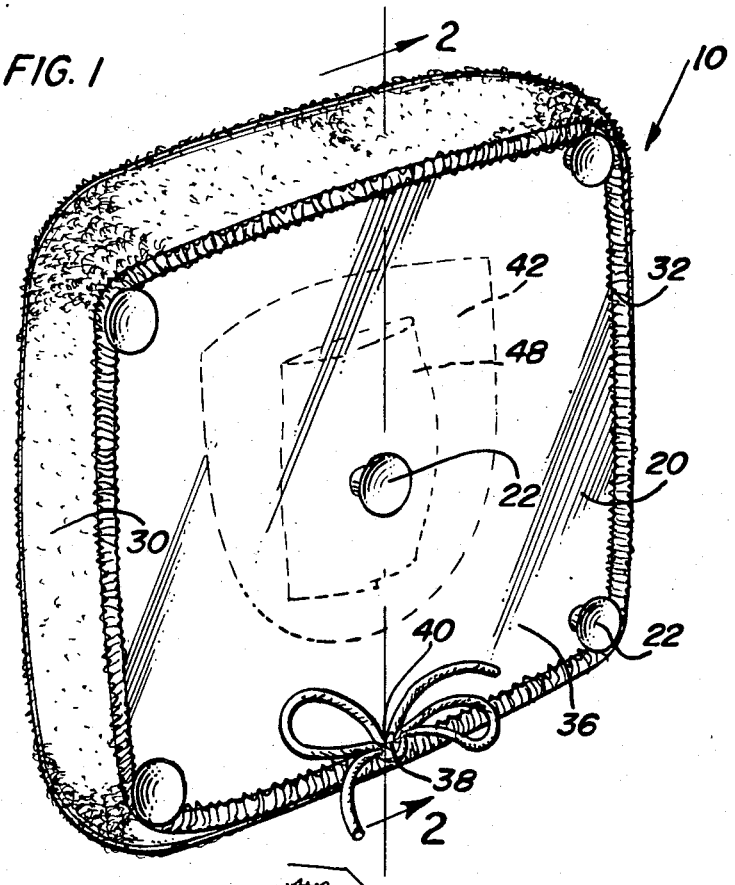
FIG. 1 is a rear perspective view of the back washer of the present invention.

A cover assembly 26 is mounted on the pad 14 and plate or panel 20 and includes a generally square or rectangular front panel 28 conforming generally in shape and configuration to the front of the pad 24 with an integral peripheral flange 30 extending around the periphery of the pad 14 and the periphery of the panel 20 as illustrated in FIG. 2. The free edge of the flange 30 is provided with a hem 32 having a drawstring 34 therein so that the drawstring can have the free ends 36 thereof extend out of an interruption 38 in the hem 32 so that knot 40 may be formed in the drawstring 34 after the free ends have been pulled to tighten the drawstrings so that the hem 32 on the flange 30 is drawn inwardly of the periphery of the plate or panel 20 along the rear surface thereof with the hem 32 being limited in its inward movement by the corner suction cups 22 as illustrated in FIG. 1. Thus, the cover assembly 26 completely covers the front of the pad 14 and the periphery of the pad and also covers the periphery of the mounting plate or panel 20 and a small portion of the peripheral back surface of the plate or panel 20. The cover panel 28, flange 30 and hem 32 are constructed of terry cloth or other suitable fabric or textile material capable of absorbing liquid and providing an adequate washing, scrubbing and massaging function and yet can be easily removed and laundered and replaced.

To facilitate application of soap or other material to the surface area of the body, the interior surface of the front cover panel 28 is provided with a pocket 42 stitched or otherwise secured thereto by stitching 44 around three sides of a generally rectangular pocket thus forming an opening 46 by which access to the pocket can be obtained. As illustrated, the pocket 42 is generally rectangular but provided with curved edges although the configuration may vary and a closure may be provided for the open end 46 if desired. As illustrated, the opening 46 into the pocket is disposed opposite to the orientation of the knot 40 in the drawstring so that when the knot in the the drawstring is positioned at a lower portion of the back washer as illustrated in FIG. 2, the opening 46 will face upwardly for receiving a net container 48 specifically adapted for receiving soap scraps 50 although a soap cake or cakes can be placed therein. The net container includes overlapped free edge portions 52 on one surface thereof to enable the soap cakes or scraps 50 to be inserted into the container with the overlapping edges retaining the soap cakes or scraps in the container. The container is of a size to be received in the pocket 42 as illustrated in FIG. 2 so that water sprayed on or applied to the fabric cover will wet the soap and by movement of the body surface against the front cover Panel 28, soap will be applied through the fabric material of the cover panel 28 to the surface area of the body that is moved along the cover panel 28. This not only provides effective washing, scrubbing or the like of the surface of the area but also provides efficient use of soap scraps which frequently are discarded and solves the problem of a person trying to apply soap to a hard to reach or inaccessible area. The mounting by use of suction cups 22 enables the back washer 10 to be adjustably mounted on a shower wall or the like for more efficient use by tall or short users and also facilitates use by children.

While the device has primary utility for washing the back and similar body surface areas when mounted on a shower bath wall or on the wall of a bathtub, it is also effective for use in massaging surface areas of the body with any desired quantity of alcohol or similar massaging compositions sprayed onto, poured onto or otherwise applied to the fabric cover. The device also makes effective use of soap scraps which can be placed in a net container in the pocket or placed directly in the pocket if desired or soap can be applied directly to the fabric cover by manually rubbing a bar of soap thereon and is very efficient when liquid soap is sprayed or otherwise applied to the exterior of the cover for easy lathering of the back. As indicated, various other materials may be applied to the cover for application to the body surface such as moisturizers, emolients, ointments and the like. Also, the device can be used for securing a hot water bag between the cover and pad and a sachet may be placed in the pocket to provide a pleasant scent. The cushion or pad can also be removed and used as a set-upon pillow.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A back washer for mounting on the wall of a shower bath, bathtub or the like, comprising a pad of resilient material having characteristics that prevent it from absorbing water, means mounting the pad from a supporting surface and a fabric cover for the pad having structural characteristics enabling it to absorb water and enabling removal and replacement of the cover so that the back or other inaccessible surface areas of the body of a person can be brought into contact with the cover for washing such surface areas when moved in relation to the cover and pad while being retained against the cover, said pad being constructed of foam plastic material and including a water proof covering mounted thereon, said means mounting the pad including a substantially rigid backing panel having a perimeter generally coinciding with the perimeter of the pad, and a plurality of suction cups mounted on the panel for mounting the panel on a supporting surface such as the vertical wall of a shower bath or the inclined wall of a bathtub, said fabric cover also engaging the panel to retain the panel, pad and cover in assembled relation, said cover including a front panel overlying and conforming generally with the dimensional characteristics of the pad and a peripheral flange overlying the periphery of the pad and a drawstring in a hem engaging the periphery of the panel and disposed inwardly of the periphery to retain the pad and cover on the panel, and a pocket on the interior of the front panel of the cover for receiving material to be applied to the surface areas of the body engaged with the cover.

2. The structure as defined in claim 1 together with a net container positioned in the pocket for receiving scrap soap for applying to the surface area of the body through the front panel of the cover.

3. The structure as defined in claim 2 wherein said pad and panel are generally rectangular in configuration and are mutually independent of each other with the cover holding the pad against the outer surface of the panel with the hem of the cover being drawn inwardly and engaging shank portions of the suction cups to position the panel in relation to the hem on the cover.

4. The structure as defined in claim 3 wherein five suction cups are provided for supporting the panel with the suction cups being located at the corners and center of the panel respectively.

* * * * *